US006119871A

United States Patent [19]

Mengel

[11] Patent Number: 6,119,871

[45] Date of Patent: Sep. 19, 2000

[54] CAROUSEL STYLE SUSPENDED SHOE RACK

[76] Inventor: Christa T. Mengel, 6772 Brent St., Coopersburg, Pa. 18036

[21] Appl. No.: 09/435,425

[22] Filed: Nov. 8, 1999

[51] Int. Cl.[7] ..... A47F 7/08

[52] U.S. Cl. ..... 211/34; 211/117; 248/339

[58] Field of Search ..... 211/34, 115, 116, 211/117, 118, 119, 38, 205, 196; 248/317, 324, 339

[56] References Cited

U.S. PATENT DOCUMENTS

| | | | |
|---|---|---|---|
| D. 190,608 | 6/1961 | Forrester | 211/118 X |
| 288,853 | 11/1883 | Poage | 211/117 |
| 337,422 | 3/1886 | Miller | 211/117 |
| 644,728 | 3/1900 | Biester | 211/117 |
| 874,318 | 12/1907 | Flugum | 211/118 |
| 889,517 | 6/1908 | Gerken | 211/117 |
| 908,548 | 1/1909 | Cloud | 211/117 |
| 1,039,359 | 9/1912 | Brown | 211/118 |
| 1,078,729 | 11/1913 | Hill | 211/118 |
| 1,937,911 | 12/1933 | Pajeau | 211/118 |
| 2,290,540 | 7/1942 | Cornetto | 211/118 |
| 2,941,669 | 6/1960 | Palay et al. | 211/196 |
| 2,962,169 | 11/1960 | Landsman | 211/118 |
| 3,018,898 | 1/1962 | Frazelle | 211/205 |
| 3,039,599 | 6/1962 | Mintz | 211/34 |
| 3,331,513 | 7/1967 | Cappelli | 211/34 |
| 3,416,673 | 12/1968 | Ballard | 211/196 |
| 3,478,890 | 11/1969 | Allsop | 211/34 |
| 3,524,616 | 8/1970 | Marschak | 211/205 |
| 3,780,875 | 12/1973 | Scholl | 211/115 |
| 3,820,694 | 6/1974 | Pabis | 211/205 |
| 4,591,420 | 5/1986 | Van Horn | 211/119 |
| 4,654,991 | 4/1987 | Jones | 211/115 |
| 4,819,817 | 4/1989 | Mar | 211/205 |
| 4,858,772 | 8/1989 | Phillipson | 211/36 |
| 5,114,017 | 5/1992 | Doyel | 211/34 |
| 5,127,528 | 7/1992 | Cone | 211/34 |
| 5,813,547 | 9/1998 | Rice | 211/34 |
| 5,862,924 | 1/1999 | Dumont | 211/118 |

*Primary Examiner*—Daniel P. Stodola
*Assistant Examiner*—Jennifer E. Novosad
*Attorney, Agent, or Firm*—Henderson & Sturm LLP

[57] ABSTRACT

A carousel style suspended shoe rack construction (10) including a plurality of elongated hollow tubular support members (20) provided with a plurality of outwardly projecting shoe support elements (30). Each tubular support member (20) is rotatably suspended from a base member (40). The base member (40) is further rotatably suspended from a ceiling (200) such that the user can rotate each individual tubular support member (20) while the base member (40) remains stationary and can likewise rotate the base member (40) to provide access to the other radially aligned tubular support members (20).

1 Claim, 1 Drawing Sheet

CAROUSEL STYLE SUSPENDED SHOE RACK

BACKGROUND OF THE INVENTION

1. Field of the Invention

The present invention relates to the field of specialized suspended support devices in general, and in particular to a carousel style suspended support device for shoes.

2. Description of Related Art

As can be seen by reference to the following U.S. Pat. Nos. 4,858,772; 5,114,017; 5,127,528; and 5,813,547, the prior art is replete with myriad and diverse rotating and/or vertical shoe tree arrangements.

While all of the aforementioned prior art constructions are more than adequate for the basic purpose and function for which they have been specifically designed, they are uniformly deficient with respect to their failure to provide a simple, efficient, and practical arrangement for rotatably suspending a plurality of free hanging shoe trees that are each designed to accommodate a plurality of shoes in a vertically staggered peripheral fashion.

As most people are aware, the most practical way to store multiple pairs of shoes is in the vertical mode with a rotating capability to provide full access to the shoes stored on or within the device.

As a consequence of the foregoing situation, there has existed a longstanding need for a new and improved low cost practical approach to the construction of a carousel style suspended shoe rack, and the provision of such a construction is a stated objective of the present invention.

BRIEF SUMMARY OF THE INVENTION

Briefly stated, the carousel style suspended shoe rack that forms the basis of the present invention comprises in general, a plurality of vertical shoe support units which are suspended from a rotatable suspension unit.

As will be explained in greater detail further on in the specification, each of the plurality of vertical shoe support units comprise an elongated hollow tubular support member having a plurality of vertically staggered peripheral rows of apertures that are dimensioned to receive a plurality of contoured framework elements. Each framework element is designed to suspend one shoe in an upright manner relative to the periphery of a selected tubular support member.

In addition, the suspension unit includes a generally flat circular base member having a bottom portion provided with a plurality of suspension elements that are operatively connected to the upper portion of the hollow tubular support members. The upper portion of the base member is provided with means for rotatably suspending the base member from an overhead support such as a ceiling.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
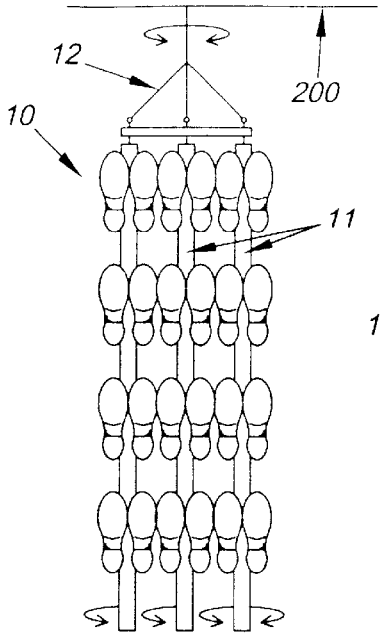
FIG. 1 is a perspective view of the carousel style shoe rack suspended from a ceiling.

As can be seen by reference to the drawings, and in particular to FIG. 1, the carousel style suspended shoe rack construction that forms the basis of the present invention is designated generally by the reference number 10. The construction 10 comprises in general, a plurality of vertical shoe support units 11 which are suspended from a rotatable suspension units 12. These units will now be described in seriatim fashion.

Figure 2:
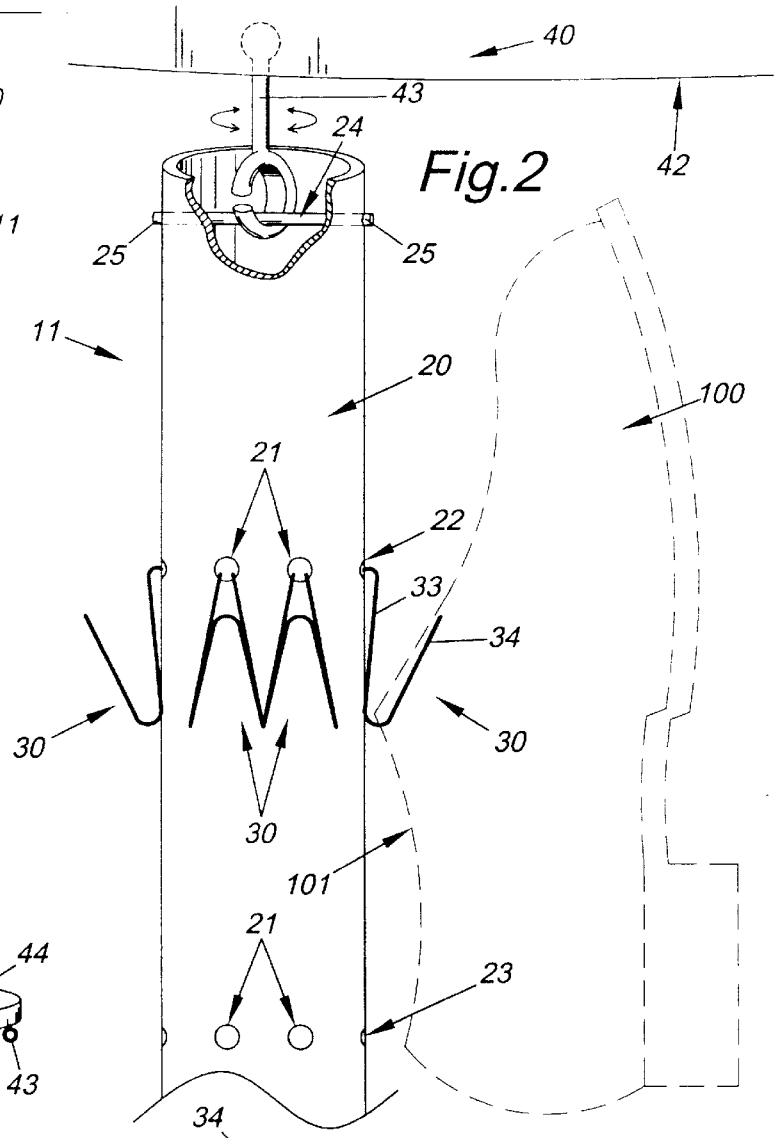
FIG. 2 is an isolated detail view of the upper end of one of the vertical shoe support members.

As shown in FIGS. 1 and 2, each of the vertical support units 11 comprise an elongated hollow tubular support member 20 having a plurality of apertures 21 arranged in a plurality of vertically staggered rows such as at 22 and 23 which extend from the top portion to the bottom portion of each tubular support member 20 at spaced intervals.

In addition, each hollow tubular support member 20 is provided with a suspension rod element 24 which is fixedly secured in diametrically opposed apertures 25 formed in the upper end of the tubular support member 20. The purpose and function of the suspension rod elements 24 will be explained in greater detail further on in the specification.

Turning now to FIGS. 2, and 5 through 7, it can be seen that the plurality of peripherally arrayed apertures are dimensioned to receive a plurality of shoe support elements 30. Each shoe support element 30 comprises a contoured wire framework member 31 having a pair of closely spaced inboard legs 32 dimensioned to be received in one of the plurality of apertures 21, a pair of downwardly angled diverging intermediate legs 33, and an upwardly and outwardly extending outboard loop portion 34 which is dimensioned to be received in the open end 101 of a shoe 100.

Figure 5:
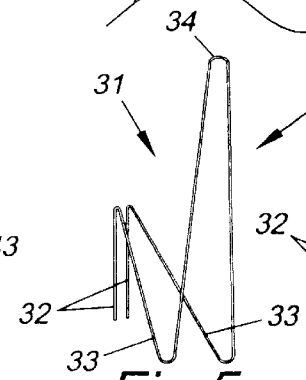
FIGS. 5 through 7 depict different sized shoe support framework elements.
Figure 6:
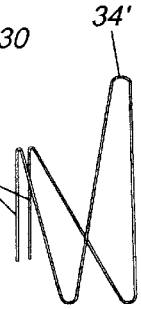
Figure 7:
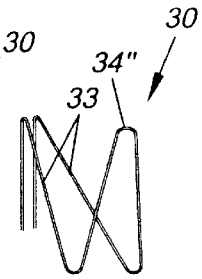

As shown in FIGS. 5 through 7, the only substantive difference in the shoe support elements 30 are the size of the loop portions 34, 34' and 34" which are dimensioned to receive men's, women's, and children's shoe, respectively.

Figure 3:
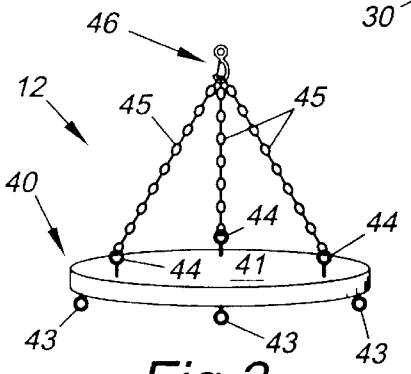
FIG. 3 is an isolated perspective view of the suspension unit as viewed from a downwardly directed angle.
Figure 4:
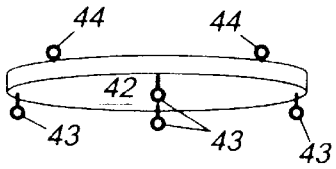
FIG. 4 is an isolated perspective view of the base member as viewed from an upwardly directed angle.

Turning now to FIGS. 3 and 4, it can be seen that the suspension unit 12 comprises a generally flat circular suspension base member 40 having a top surface 41 and a bottom surface 42. The bottom surface 42 is provided with a plurality of suspension hook elements 43 having a lower portion dimensioned to receive the suspension rod element 24 and an upper portion which is rotatably suspended from the bottom surface 42 of the base member 40.

In addition, the top surface 41 of the base member 40 is provided with a plurality of equidistantly spaced eyelets 44 which are connected to the lower ends of lengths of chain 45 wherein the upper ends of the lengths of chain are captively engaged in a rotating swivel member 46 that is designed to be suspended from a ceiling.

By now it should be appreciated that each of the tubular support members 20 are mounted in a free swinging rotatable fashion relative to the base member 40 and the base member 40 is rotatable relative to the ceiling to provide quick easy and unfettered access to a desired pair of shoes suspended from the construction.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A carousel style shoe rack construction for vertically supporting a plurality of pairs of shoes in a rotatable fashion wherein the construction comprises:

a suspension unit including a generally flat circular base member having an outer periphery, bottom surface and a top surface adapted to be rotatably suspended from an overhead support, a plurality of shoe support units wherein each shoe support unit includes an elongated hollow tubular support member provided with a plurality of vertically spaced apertures, a lower portion and an upper portion whereby the support members are rotatably suspended in a free swinging manner from the bottom surface of the base member; wherein, the plurality of tubular support members are arranged around the outer periphery of the base member; and, a plurality of shoe support elements wherein each shoe support element comprises a contoured framework member having one end dimensioned to be received in one of said vertically spaced apertures; wherein, the contoured framework member includes a pair of downwardly depending inboard legs, and a pair of outwardly diverging and downwardly depending intermediate legs which terminate in a generally vertically extending loop portion.

* * * * *